US008925631B2

(12) United States Patent
Patel

(10) Patent No.: US 8,925,631 B2
(45) Date of Patent: Jan. 6, 2015

(54) LARGE BORE COMPLETIONS SYSTEMS AND METHOD

(75) Inventor: Dinesh Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 540 days.

(21) Appl. No.: 13/038,921

(22) Filed: Mar. 2, 2011

(65) Prior Publication Data

US 2011/0214883 A1 Sep. 8, 2011

Related U.S. Application Data

(60) Provisional application No. 61/310,691, filed on Mar. 4, 2010.

(51) Int. Cl.
*E21B 43/12* (2006.01)
*E21B 23/00* (2006.01)

(52) U.S. Cl.
CPC ..... *E21B 23/00* (2013.01)
USPC ..... 166/250.01; 166/378; 166/65.1

(58) Field of Classification Search
USPC ..... 166/313, 369, 381, 382, 297, 250.01, 166/65.1, 66.7, 378, 386
See application file for complete search history.

(56) References Cited

U.S. PATENT DOCUMENTS

| | | | | |
|---|---|---|---|---|
| 3,971,317 | A | 7/1976 | Gemmell et al. | |
| 5,052,489 | A | 10/1991 | Carisella et al. | |
| 5,062,485 | A | 11/1991 | Wesson et al. | |
| 5,146,983 | A | 9/1992 | Hromas et al. | |
| 5,203,414 | A | 4/1993 | Hromas et al. | |
| 5,316,087 | A | 5/1994 | Manke et al. | |
| 5,490,563 | A | 2/1996 | Wesson et al. | |
| 5,611,567 | A | 3/1997 | Hoo | |
| 5,819,854 | A | 10/1998 | Doane et al. | |
| 5,831,156 | A * | 11/1998 | Mullins | 73/152.18 |
| 6,095,247 | A | 8/2000 | Streich et al. | |
| 6,164,375 | A | 12/2000 | Carisella | |
| 6,450,263 | B1 | 9/2002 | Schwendemann | |
| 6,571,886 | B1 | 6/2003 | Sullivan et al. | |
| 6,840,317 | B2 * | 1/2005 | Hirsch et al. | 166/250.15 |
| 7,237,616 | B2 | 7/2007 | Patel | |
| 7,337,850 | B2 | 3/2008 | Contant | |
| 7,510,001 | B2 | 3/2009 | Spring et al. | |
| 8,037,940 | B2 * | 10/2011 | Patel et al. | 166/386 |
| 8,118,098 | B2 | 2/2012 | Hromas et al. | |
| 2007/0227727 | A1 * | 10/2007 | Patel et al. | 166/250.01 |
| 2011/0056679 | A1 | 3/2011 | Rytlewski | |

* cited by examiner

*Primary Examiner* — David Andrews
(74) *Attorney, Agent, or Firm* — David J. Groesbeck; Brandon S. Clark

(57) ABSTRACT

A technique facilitates use and installation of a large bore completion system. The technique comprises providing infrastructure during an initial completion stage and deploying a monitoring system. Based on data from the monitoring system, an intelligent completion may later be deployed as necessary to control production, injection, or other well related fluid flows.

20 Claims, 9 Drawing Sheets

LARGE BORE COMPLETIONS SYSTEMS AND METHOD

CROSS-REFERENCE TO RELATED APPLICATION

The present document is based on and claims priority to U.S. Provisional Application Ser. No. 61/310,691, filed Mar. 4, 2010, incorporated by reference herein.

BACKGROUND

1. Field of the Invention

The present invention relates generally to well completion systems, and more particularly to large bore completion systems and methods of installing the large bore completion systems. The methodology may include monitoring a reservoir parameter to facilitate performance of a corrective action. Various embodiments of the concepts presented herein may be applied to a wide range of applications and fields as appropriate.

2. Description of the Related Art

Hydrocarbon fluid such as oil and natural gas are obtained from a subterranean geologic formation, referred to as a reservoir, by drilling a well that penetrates the hydrocarbon-bearing formation. Once a wellbore is drilled, various forms of well completion components may be installed to control and enhance efficiency of producing the various fluids from the reservoir. In some cases, a single wellbore may access two or more zones of one or more formations. Current practice is to run a completion component, such as a casing plug, to provide a barrier between the individual zones. The casing plug establishes barriers which may provide for selective stimulations and flow back. Additionally, a plug is provided above the top zone to provide a barrier during, for example, upper completion workovers. Current practices also may involve running an intelligent completion and sensors during initial completion of the well or when the well is worked over by pulling the production tubing. The expense of intelligent completion of the well is incurred at the very beginning of the process. In some cases, the need for an intelligent completion is not known until the well flows over a period of time. If the intelligent completion costs are incurred upfront and a later determination is made that the intelligent completion is not needed, the investment is wasted.

Therefore, a need exists for providing an infrastructure during the initial completion stage in which only a monitoring system is deployed so that data from the monitoring system may be used to determine the need for later replacing the monitoring system with an intelligent completion to control production or injection as desired. Furthermore, problems exist in existing systems because plugs may not be sufficiently reliable and may fail to provide a gas tight barrier, leading to well control issues. In some cases, plugs also can be difficult to retrieve. When using plugs, an intervention is sometimes required for measurement and water shut off of the zone and/or well.

SUMMARY

Embodiments claimed herein may comprise large bore completion systems and methods of installation. The methodology comprises providing infrastructure during an initial completion stage and deploying a monitoring system. Based on data from the monitoring system, an intelligent completion may later be deployed as necessary to control, for example, production or injection.

Other or alternative features will become apparent from the following description, from the drawings, and from the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

Figure 1:
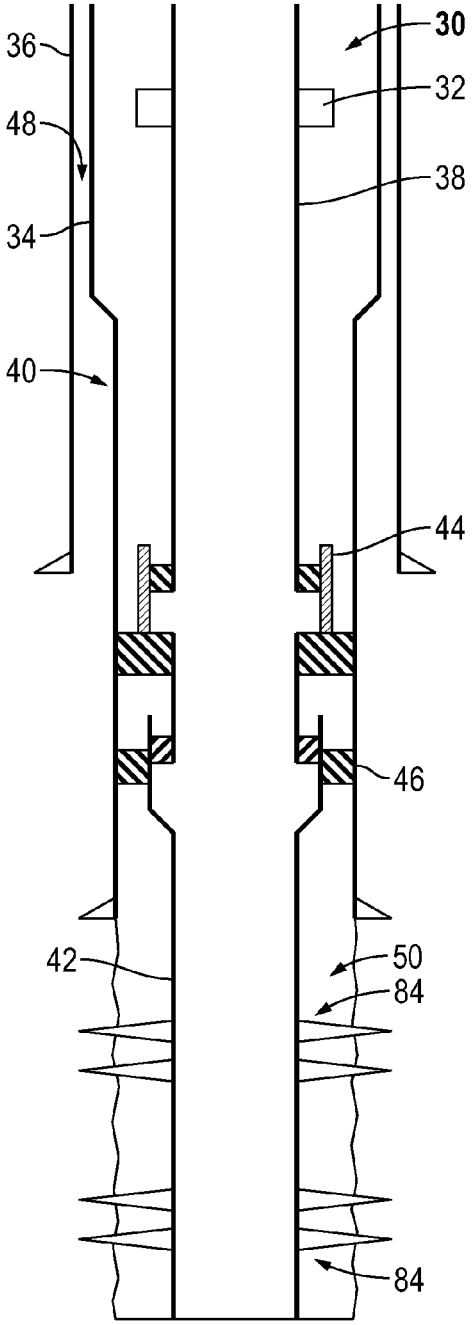
FIG. 1 (Prior Art)
FIG. 1 is a schematic illustration of a current completion system.

In the following description, numerous details are set forth to provide an understanding of some illustrative embodiments of the present invention. However, it will be understood by those skilled in the art that various embodiments of the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention.

One aspect of an embodiment of the current invention comprises formation isolation valves (FIVs) in place of a system of plugs for isolating and sealing various sections of the completion. The FIVs may be run in hole and cemented along with a liner. In some applications, embodiments of the system may comprise running a retrievable, instrumented stinger inside of a lower completion. The instrumented stinger can be used to provide real-time measurements via one or more sensors. For example, various sensors, e.g. pressure, temperature, water cut, resistivity, acoustic, and other types of sensors, can be run in the form of discrete sensors and/or distributed sensors, such as fiber optic sensors. A wet connect also may be provided in the upper completion to couple the instrumented stinger into the lower completion. The wet connect may comprise one or more connections, such as hydraulic, electric, inductive coupler, and/or fiber optic connections.

Embodiments described herein may be used to enable elimination of perforating. For example, treatment and production (TAP) valves, e.g. sliding sleeve type valves, may be run and cemented with the liner. TAP valves may be configured to selectively open for both simulation and production. A TAP valve also may be used to remove the need for perforating a casing downhole.

In some applications, embodiments described herein provide for retrieval of the instrumented stinger at a later date and/or upon the occurrence of a particular event, e.g. occurrence of water break. After which, the instrumented stinger may be replaced with an intelligent completion comprising flow control valves and measurement sensors and/or other components. The intelligent completion may be configured to control/shut off water production. Control over water production has the potential to extend the life of a well and to provide for more efficient and effective production. Some embodiments also may provide the ability to eliminate cementing by running liner sections combined with stimulation valves and open hole zonal isolation packers with the liner in the open hole conditions. It should be noted that common components are labeled with the same reference numerals throughout the embodiments described below.

Figure 2:
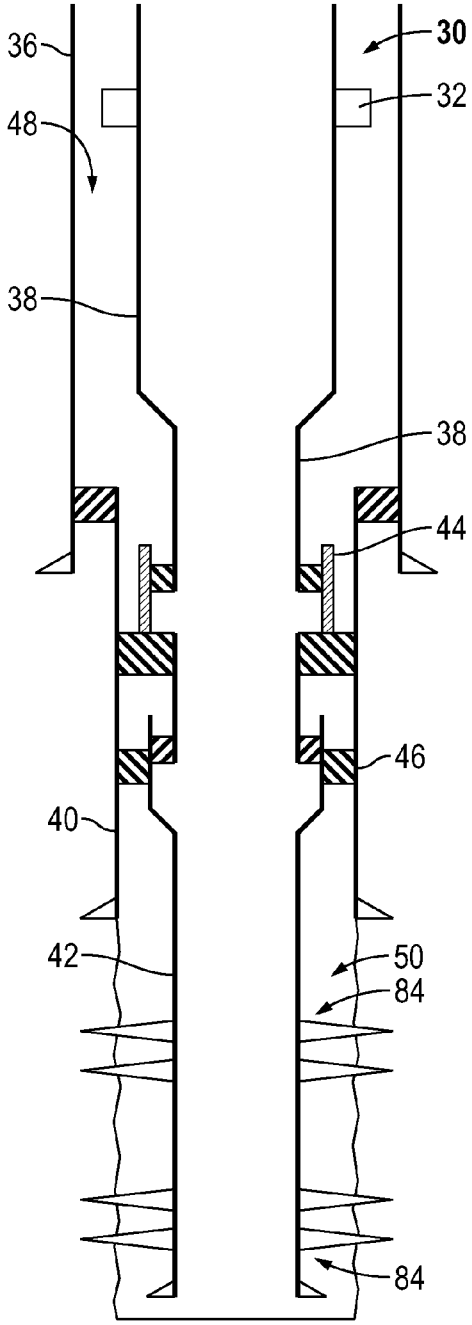
FIG. 2 (Prior Art)
FIG. 2 is another schematic illustration of a current completion system.

Referring in general to FIGS. 1 and 2, some current completions 30 employ a surface controlled subsurface safety valve (SCSSV) 32 within casing 34 which, in the system illustrated, is located within a larger diameter casing 36. The SCSSV 32 may be coupled with production tubing 38, which extends down below casing 36. An upper liner section 40 may be positioned between the production tubing 38 and casing 36 and extend below both. Additionally, a lower liner section 42 may be sealed to a bottom of the production tubing 38 via an assembly 44. A liner hanger and seal assembly 46 is employed to secure the lower liner section 42 to the bottom of the upper liner section 40. The overall completion 30 is deployed in a wellbore 48.

The lower liner section 42 may further expand into an open hole section 50 of wellbore 48. This lower liner section 42 may be perforated to form perforations 52 which allow production into and/or stimulation out of the interior of the lower liner section 42. Once production fluid flows into the lower liner section 42, the fluid proceeds to the surface via an interior of the lower liner section 42 and production tubing 38. The lower liner section 42 may extend into two or more production zones, such as the two zones illustrated in FIG. 1.

Different completion sizes may be appropriate for different conditions downhole. For example, the embodiment illustrated in FIG. 2 represents a larger size completion relative to the similarly configured, smaller sized large bore completion illustrated in FIG. 1. Various factors determine the size of completion, including factors related to the surrounding geology, costs, predicted production amount, and type of production.

Figure 3:
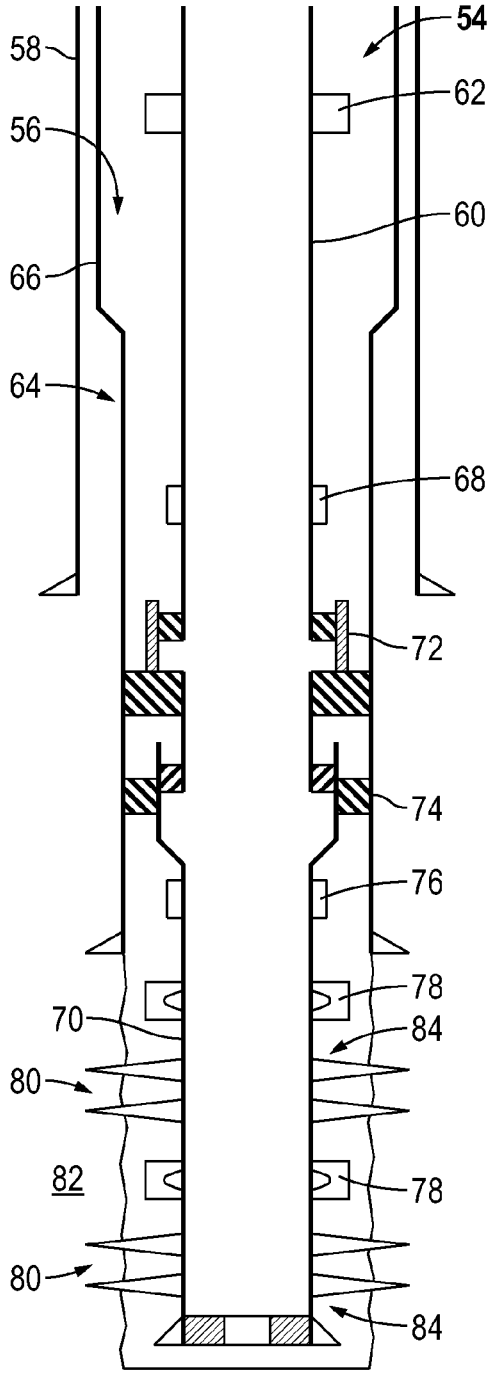
FIG. 3 is a schematic illustration of a large bore completion system, according to an embodiment of the disclosure.
Figure 4:
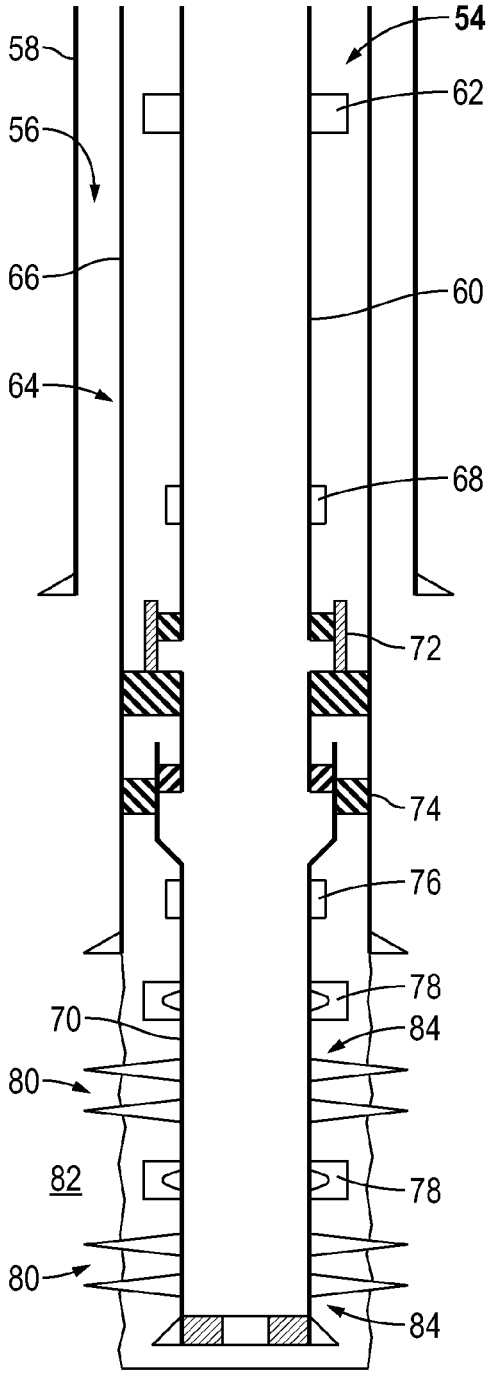
FIG. 4 is a schematic illustration of a large bore completion system, according to another embodiment of the disclosure.

Referring generally to FIGS. 3 and 4, an embodiment of the present invention is illustrated. In this embodiment, a large bore completion system 54 is illustrated as deployed in a wellbore 56. From a surface location, a casing 58 and a production tubing 60 extend downwardly within wellbore 56. In this example, a surface controlled subsurface safety valve (SCSSV) 62 may be coupled to the production tubing 60 to enable selective closure of the interior passage/bore of the production tubing 60 in the event of an emergency and/or to suspend or shut off production. An upper liner section 64 may be positioned radially between the production tubing 60 and casing 58 and extend below both. As illustrated, the upper liner section 64 may extend up beyond SCSSV 62 or it may join an interior casing section 66. In some embodiments, the casing section 66 simply extends down past production tubing 60, as illustrated in the embodiment of FIG. 4. Additionally, a sliding sleeve 68 may be provided below the SCSSV 62; and below the sliding sleeve 68, the production tubing 60 may be coupled to a lower liner section 70 via an assembly 72. By way of example, assembly 72 comprises components such as a liner top packer, a polished bore receptacle, and a seal assembly. The lower liner section 70 may be coupled to a bottom of the upper liner section 64/casing section 66 via a suitable assembly 74, such as a liner hanger and seal assembly.

In some applications, a completion component 76, such as a nipple, is positioned below liner hanger and seal assembly 74 and one or more formation isolation valves (FIVs) 78 can be located below the completion component 76. By way of example, the completion component/nipple 76 may be fabricated as a short section of heavy wall tubular with a machined internal surface which provides a seal area and a locking profile. Examples of landing nipples which may be employed comprise no-go nipples, selective-landing nipples, imported or safety-valve nipples. The FIVs 78 may be configured to close off the formation at a particular location in the lower liner section 70. In the example illustrated, closing of the upper FIV 78 shuts off or suspends production flow from all zones 80 of a surrounding formation 82. In some embodiments, closure of the lower FIV 78 is employed to close off production from the lower well zone 80. In such case, the lower FIV 78 may be closed upon detection of a reservoir parameter, e.g. water production, in the lower zone 80 while production is allowed to continue from the upper zone or zones 80 as fluid enters through appropriate perforations 84.

As briefly discussed above, FIVs 78 may be positioned in the lower liner section 70 to individually control production from each zone of the plurality of individual zones 80. The FIVs 78 also may be manipulated to control individual stimulation of each of the zones 80 during, for example, injection of fluids into a formation 82. By way of example, the FIVs may be manipulated with a shifting tool run on an appropriate conveyance, such as coiled tubing or slickline. However, automated controls and other methods also may be employed to selectively control the individual FIVs 78.

The sizes and exact configurations of the downhole completion systems 54 may depend on a variety of factors. The Figures illustrate examples of types of large bore completions which are appropriately designed for intended applications. However, a person of skill in the art recognizes that actual designs of the large bore completions may include additional/alternate/combined components with variations in size and functionality.

Figure 5:
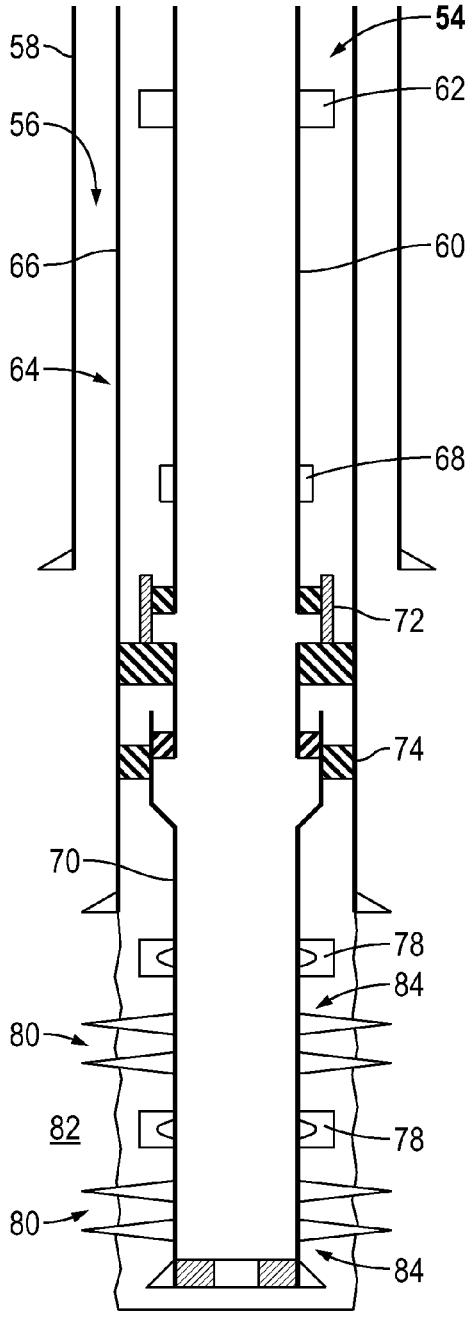
FIG. 5 is a schematic illustration of a large bore completion system, according to another embodiment of the disclosure.

Referring generally to FIG. 5, another embodiment of the completion system 54 is illustrated. The embodiment illustrated in FIG. 5 is similar to the embodiments illustrated in FIGS. 3-4 but it does not include a nipple below assembly 74, e.g. liner hanger and seal assembly. Instead, the lower liner section 70 simply extends downwardly from assembly 74 to FIVs 78.

Figure 6:
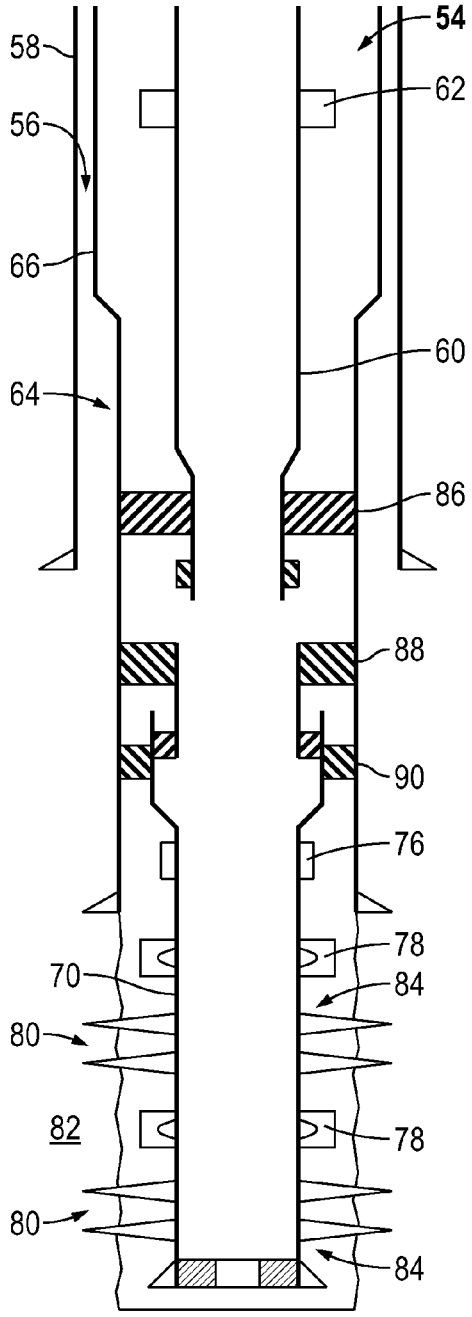
FIG. 6 is a schematic illustration of a large bore completion system, according to another embodiment of the disclosure.

Referring generally to FIG. 6, another embodiment of the large bore completion system 54 is illustrated and is similar to embodiments illustrated in FIGS. 3-5 in at least some aspects. However, in the embodiment illustrated in FIG. 6, production tubing 60 is not directly coupled to the lower liner section 70. Instead, a bottom end of the production tubing 60 is coupled and sealed to the interior casing section 66 by a packer 86, such as a hydrostatic set packer. In this example, the lower liner section 70 is connected to a bottom end of the inner casing 66 via suitable coupling components, such as a liner top packer 88 and a liner hanger 90. Production fluid flow moves up through lower liner section 70, into the region between packers 86 and 88, and up through production tubing 60.

Figure 7:
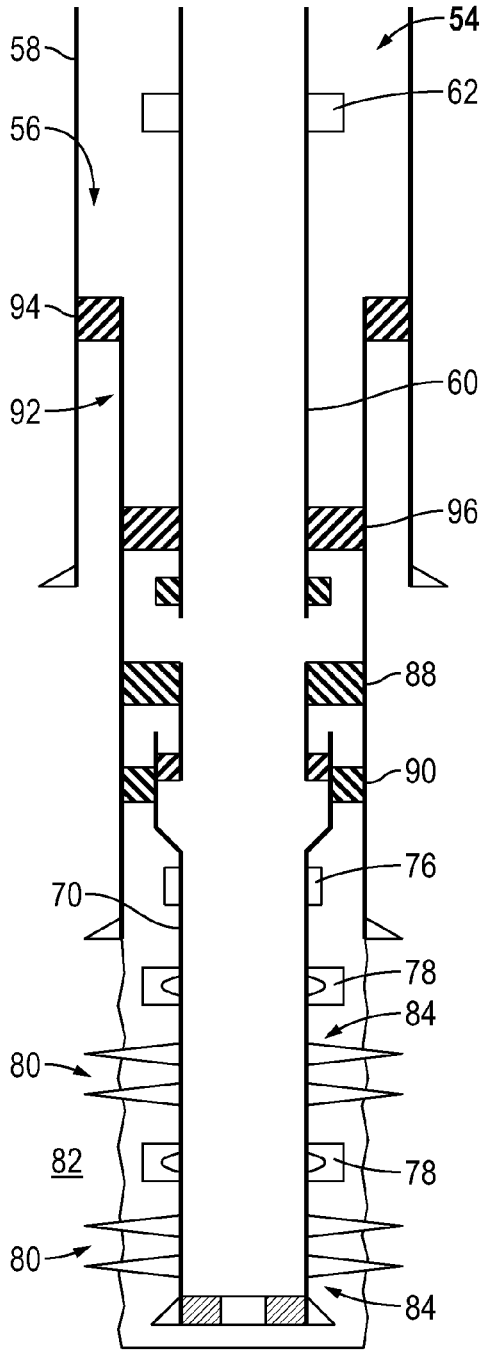
FIG. 7 is a schematic illustration of a large bore completion system, according to another embodiment of the disclosure.

Referring generally to FIG. 7, another embodiment of the large bore completion system 54 is illustrated and is similar to the embodiment illustrated in FIG. 6 in at least some aspects. However, in the embodiment illustrated in FIG. 7, an upper liner section 92 is coupled to a lower portion, e.g. bottom, of the casing 58 via a hanger/seal 94. The production tubing 60 may be coupled and sealed to the upper liner section 92 via a suitable seal and/or anchor. For example, a packer 96, e.g. a hydrostatic set packer, may be deployed between production tubing 60 and the hanging upper liner section 92. The packer 96 effectively directs production fluid to an interior of the production tubing 60. The lower liner section 70 also may be coupled to the upper liner section 92 via a liner top packer and a liner hanger, such as liner top packer 88 and liner hanger 90. As illustrated, the lower liner section 70 does not have to be directly coupled to the production tubing 60, although they may be coupled together functionally via one or more components.

Figure 8:
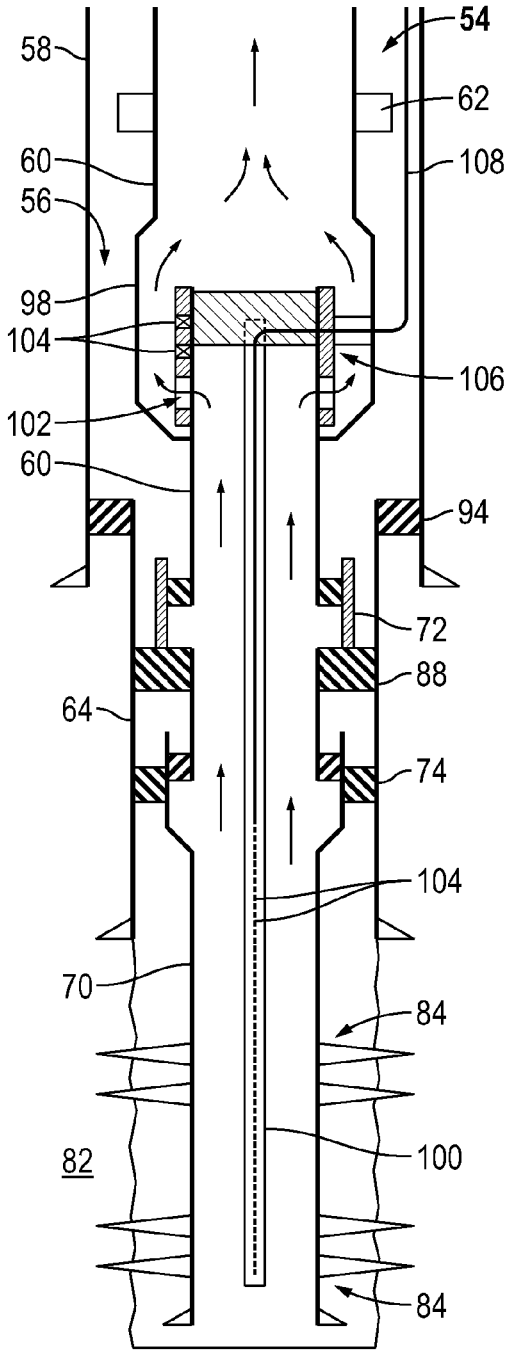
FIG. 8 is a schematic illustration of a large bore completion system with measurement capability across the formation, according to another embodiment of the disclosure.

In FIG. 8, another embodiment of the completion system 54 is illustrated and is similar to previously described embodiments in at least some aspects. However, the embodiment illustrated in FIG. 8 has several differences as described in greater detail below. For example, the infrastructure is provided in an initial completion stage and an instrumented stinger is run for monitoring well parameters in real time. The stinger is then retrieved and replaced with an intelligent completion to control the flow, production and/or injection. As illustrated, a SCSSV 62 may be coupled to production tubing 60 and run inside of casing 58. At a lower portion, e.g. bottom end, of the production tubing 60 a shroud 98 is employed to create a shroud flow area which accommodates a retrievable, instrumented stinger 100. The retrievable instrumented stinger 100 may have one or more ports 102 located at, for example, a top portion of the stinger 100 to allow flow to proceed from an interior of the lower liner section 70 to an interior of the production tubing 60 via an interior flow region of the shroud 98.

In the embodiment illustrated in FIG. 8, the upper liner section 64 may be coupled to a lower, e.g. bottom, region of casing 58 via the assembly 94, such as a liner hanger and seal assembly. Additionally, the lower section of the production tubing 60 may be coupled to either the upper liner section 64 or the lower liner section 70 (or even the casing 58) via one or more assemblies, such as assembly 72 and assembly 74. By way of example, assembly 72 may comprise a liner top packer, a polished bore receptacle, and a seal assembly coupling the production tubing 60 and the lower completion section 64. By way of further example, assembly 74 may comprise a liner hanger and seal assembly coupling the lower liner section 70 with the upper liner section 64 and/or production tubing 60.

As discussed above, the retrievable stinger 100 may be instrumented and comprise one or more sensors 104 to detect and determine various wellbore parameters. For example, sensors 104 may include pressure sensors, temperature sensors, water cut sensors, strained sensors, flow rate sensors, and/or other types of sensors. Additionally, the sensors 104 may be discrete sensors or distributed sensors, such as fiber optic distributed temperature sensors. The retrievable, instrumented stinger 100 may be coupled to the surface via a wet connect 106 and a communication line 108. The wet connect 106 may be designed to form electrical, hydraulic, inductive, optical, and/or combination connections for delivering signals downhole and/or uphole, including sending power signals downhole. In some embodiments, the communication line 108 may comprise tubing which enables the pumping of optical fiber downhole. In any of these applications, the use of wet connect 106 enables connection and disconnection of the retrievable, instrumented stinger 100. The communication line 108, e.g. electrical cable and/or conduit, may be run in hole with production tubing 60. The stinger 100 may be used to detect an event, e.g. water intrusion, and then retrieved so that a lower completion system may be run in hole to control the water intrusion. In this example, production fluid is able to flow to the surface via the interior of the lower liner section 70, the interior of the production tubing section 60, ports 102 of the joint run below the female portion of wet connect 106, the annulus area between the flow shroud 98 and female wet connect portion 106, and the interior of production tubing 60 above shroud 98.

Figure 9:
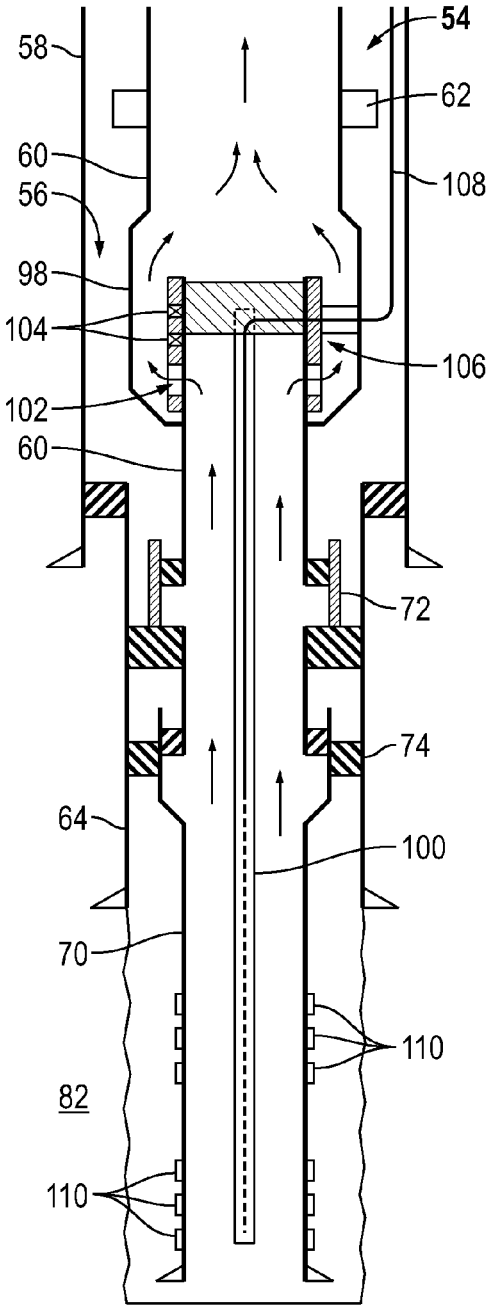
FIG. 9 is a schematic illustration of a large bore completion system with a cemented TAP valve and measurement across the formation, according to another embodiment of the disclosure.

Referring generally to FIG. 9, another embodiment of the completion system 54 is illustrated and is similar to the embodiment illustrated in FIG. 8 in at least some aspects. However, in the embodiment illustrated in FIG. 9, the lower liner section 70 comprises a plurality of treatment and production (TAP) valves 110. The valves 110 may be run in and cemented along with the lower liner section 70. Use of the TAP valves 110 enables both stimulation and production by providing access to the surrounding formation 82 without requiring a separate perforation operation. In this embodiment and in some of the other embodiments described herein, the lower, open section of wellbore 56 may benefit from under reaming.

Figure 10:
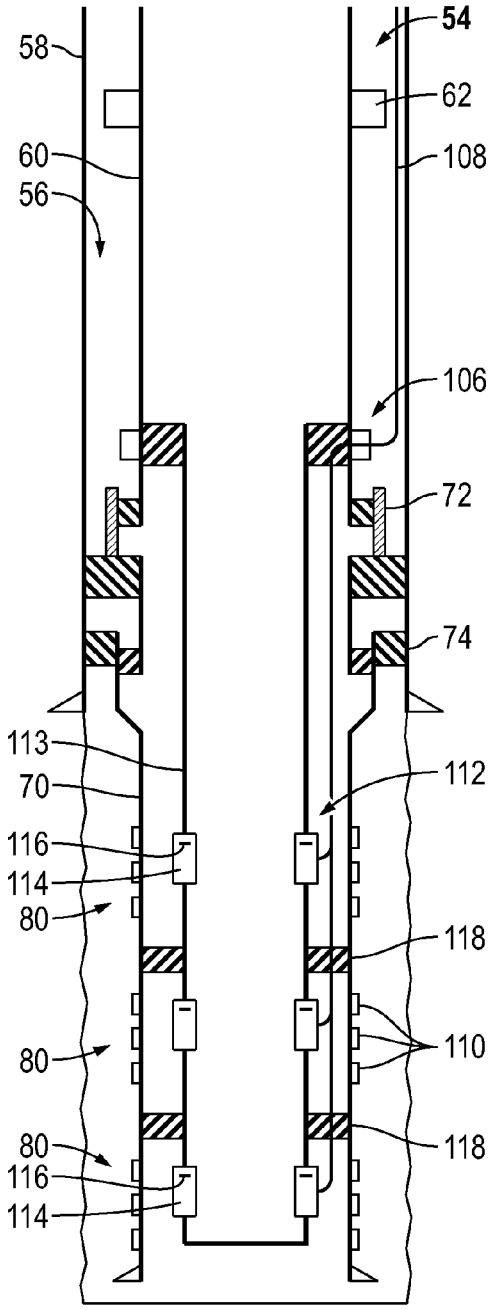
FIG. 10 is a schematic illustration of a large bore completion system with a cemented TAP valve and intelligent completion components, according to another embodiment of the disclosure.

A variation of the embodiment illustrated in FIG. 9 is presented in FIG. 10. In this example, the infrastructure is provided in the initial completion stage, and an intelligent completion for controlling the flow, production, and/or injection is run at a later time when required. In this particular embodiment, the need for an instrumented stinger is eliminated. Instead, production logging or other sensors are periodically run inside the tubing string on wireline, coiled tubing, or slick line to measure various well parameters and to provide data for determining the need for running an intelligent completion. As illustrated in FIG. 10, an intelligent completion section 112 is provided and comprises a tubing 113. The intelligent completion section 112 is delivered downhole and employed to control and limit the intrusion of water and to thus further extend the life and/or efficiency and effectiveness of the well.

In the example illustrated, the intelligent completion section 112 may be coupled to the surface via communication line 108, e.g. an electric, hydraulic, optical, and/or combination communication lines. In this example, the communication line 108 is coupled to the intelligent completion section 112 through wet connect 106. The wet connect 106 is able to provide control and/or feedback signals to/from active flow control valves 114 and gauges 116 included in the intelligent completion section 112. Additionally, isolation seals or packers 118 may be located around intelligent completion section 112 to segment or separate the formation (or collection of individual formations) into separately controllable zones 80. For example, retrievable feedthrough packers may be employed to accommodate the routing of communication line 108 to the various flow control valves and gauges. In the example illustrated in FIG. 10, three zones 80 are established through the use of two isolation packers 118 sealed against an interior of the lower liner section 70. As a result of the sectioning, if water is present in only the third zone 80, the corresponding gauge 116 detects water intrusion and either sends the information to a controller at the surface to shut off the lower flow control valve 116 or sends a command to automatically shut off the flow control valve 116, thus restricting the water entering in through the third zone 80.

Figure 11:
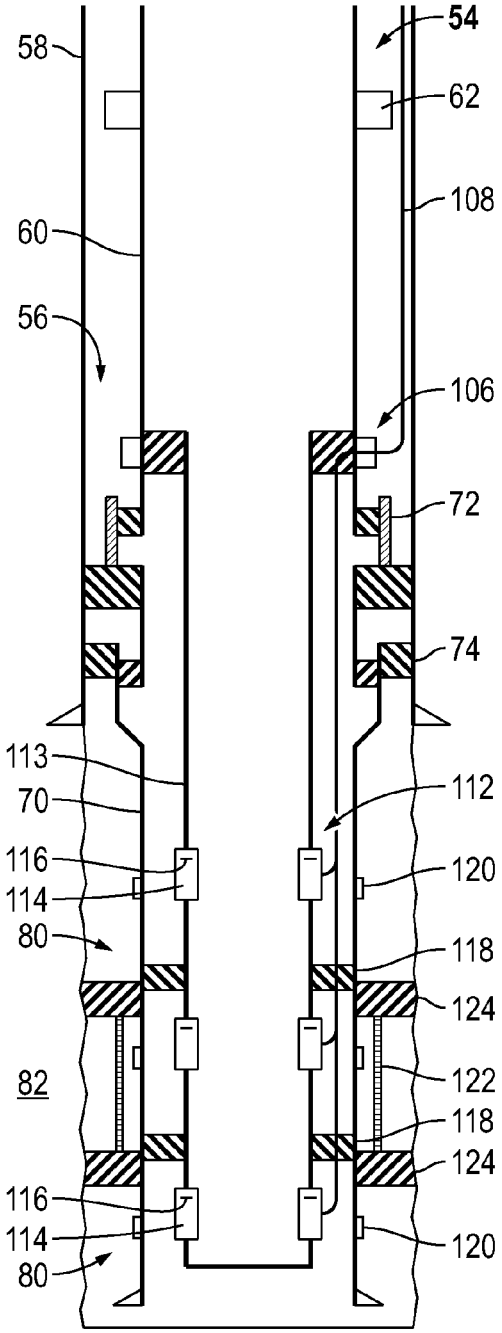
FIG. 11 is a schematic illustration of a large bore completion system with a stimulations sleeve valve and intelligent completion components, according to another embodiment of the disclosure.

Referring generally to FIG. 11, another embodiment of the completion system 54 is illustrated and is similar to the embodiment illustrated in FIG. 10 in at least some aspects. However, in the embodiment illustrated in FIG. 11, the lower liner section 70 may include stimulation sliding sleeves 120 along with optional screens 122, such as sand control screens, and open hole isolation packers 124, such as swell packers or mechanical packers. The isolation packers 124 are employed to section or segment single or multiple formations into a variety of zones 80 so that each zone is separately controllable.

As with the embodiment illustrated in FIG. 10, the intelligent completion section 112 may be included to further control the zones via the gauges 116 and controllable flow control valves 114. The isolation packers 118 used to segment the intelligent completion section 112 may be retrievable feed through packers, i.e. packers configured to allow the passing of a communication line such as a cable or conduit. This configuration of the large bore completion system 54 enables stimulation and production to occur without the need for perforating the lower liner section 70.

Figure 12:
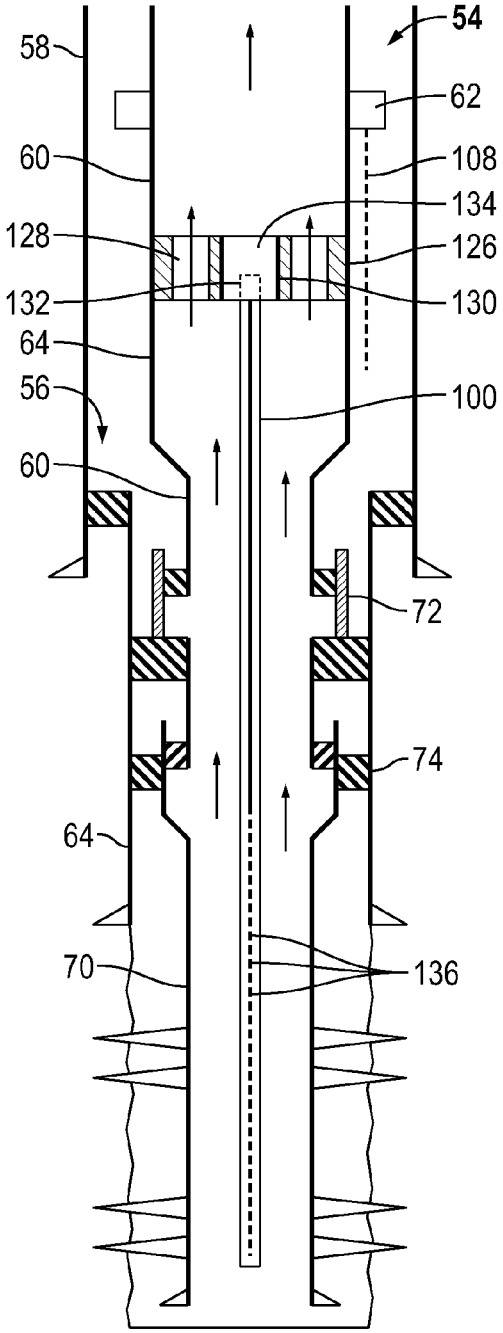
FIG. 12 is a schematic illustration of a large bore completion system with a retrievable instrumented stinger, according to another embodiment of the disclosure.

In FIG. 12, another embodiment of the completion system 54 is illustrated and is similar to some of the embodiments described above in at least some aspects. However, in the embodiment illustrated in FIG. 12, a retrievable anchor 126 is located below the SCSSV 62 and is anchored to the interior wall of the upper liner section 64. The retrievable anchor 126 is provided with one or more ports 128 that allow for the flow of production fluid to the surface or to another collection location, as indicated by the upwardly directed arrows. During well stimulations, however, the flow can be reversed to direct fluid down to the surrounding formation. The retrievable anchor 126 also may be configured to accept the retrievable instrumented stinger 100. In some cases, the completion system 54 may further comprise communication line 108 in the form of an electric cable or hydraulic control line configured to pump fiber optic cable therethrough. The communication line 108 enables transfer of communication signals which, in turn, facilitate placement of various sensors, e.g. fiber optic distributed temperature and vibration sensors. As with previous embodiments, the stinger 100 may be retrieved upon the occurrence of an event or after a specific passage of time and then replaced with an intelligent completion as illustrated in, for example, FIG. 10 or FIG. 11.

In the example illustrated in FIG. 12, the retrievable instrumented stinger 100 may be coupled to the retrievable anchor 126 via a stinger latch 130. In addition to the stinger latch 130, the retrievable instrumented stinger 100 may include a battery 132 and a data storage device/recorder 134 to record measurements from various discrete and/or distributed sensors 136 located along the well face. As with previous embodiments, the stinger 100 may be retrieved upon the occurrence of an event or passage of time to, for example, recharge/replace the power supply 132 or to download data from the data recorder 134. It should be noted that embodiments described above generally are for new wells in which an infrastructure for communication and for power is provided in the initial completion/completion stage. Embodiments described below may generally be employed with existing wells where infrastructure for communication and power do not exist in an initial completion.

Figure 13:
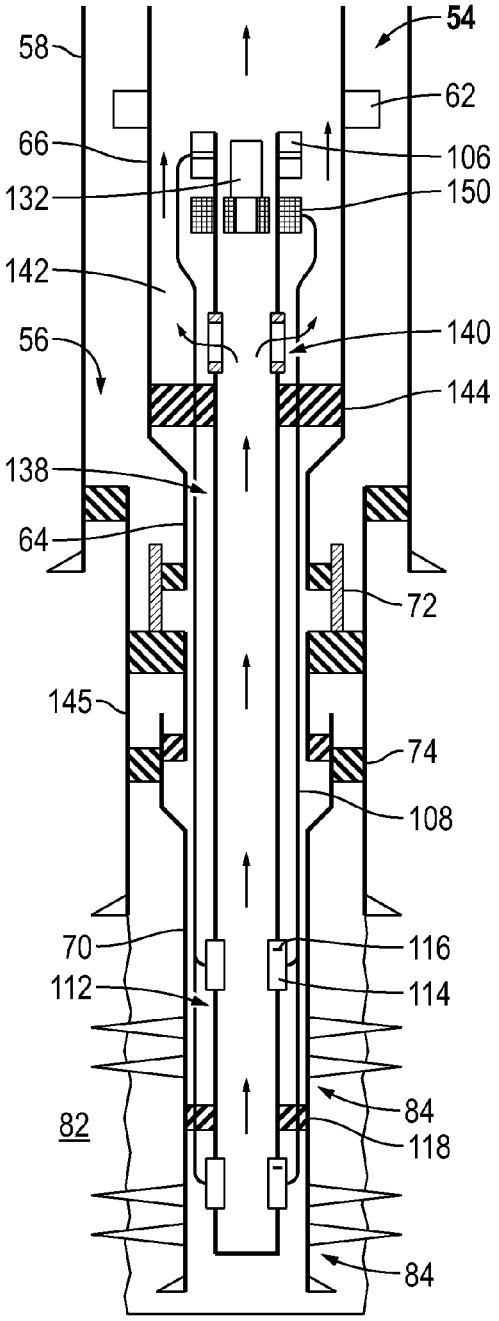
FIG. 13 is a schematic illustration of a large bore completion system that utilizes periodic intervention to retrieve and/or replace a battery/power source and data storage component, according to another embodiment of the disclosure.

Referring generally to FIG. 13, another embodiment of the completion system 54 is illustrated and is similar to previously described embodiments in at least some aspects. However, in the embodiment illustrated in FIG. 13, the upper liner section 64 or casing 66 is used to establish a conduit for fluid flow to the surface or flow down to the formations 82. In this embodiment, an internal, lower completion system 138 is placed within or through upper liner section 64 and lower liner section 70 to control and/or measure various well system parameters. As illustrated, the lower completion system 138 may work in cooperation with wet connect 106 which has the configuration of a hydraulic, electric, optic, inductive coupler, and/or combination type wet connect provided in part at the upper portion, e.g. top, of the lower completion system 138. As described above, the instrumented stinger 100 may initially be deployed downhole to detect an event, such as water intrusion. After detection of the water intrusion or other event, the instrumented stinger 100 is removed, and a lower completion system, e.g. lower completion system 138, is run in hole to block or otherwise control water intrusion from the specific zone or zones 80 at which the event was detected. The water intrusion may be controlled by controlling the appropriate valves 114 corresponding to the desired well zones.

Additionally, the power source/battery 132 may be provided at, for example, the top of lower completion system 138 or at another suitable location to power and/or control the various valves and sensors of the lower completion system 138, e.g. flow control valves 114 and gauges/sensors 116. In some cases, the retrievable power source 132 also may include the data storage component 134, e.g. a data recorder, along with the corresponding processing components having the capability to store data received from the sensors and to enable action based on that data when desired.

In this example, the retrievable power source 132 is located at the top of lower completion system 138, and one or more slotted pup joints 140 may be located below the retrievable power source 132 to provide access to an interior region 142 of the upper liner section 64/casing 66. The lower completion section 138 may be positioned below the SCSSV 62 to maintain the functionality of the SCSSV 62 in the event of an emergency. The lower completion section 138 may be coupled to the upper liner section before via a feed through packer 144. In this embodiment, the feed through packer 144 is configured to provide a pathway for one or more communication lines 108, e.g. conduits, cables, optical lines, or other control lines, extending to components located below the feed through packer 144. Also, an additional lower liner section 145 may be suspended from casing 58 and positioned around the lower part of upper liner section 64 and around lower liner section 70.

As with other embodiments discussed above, the lower completion section 138 also may include retrievable feed through packers/seals 118 to segment or segregate a formation or a series of individual formations into one or more individually controllable zones 80. In the illustrated embodiment, one retrievable packer 118 has been employed to segregate the lower completion system 138 into two distinct zones. Each zone may be controlled by corresponding assemblies having flow control valves 114 and sensors 116. This type of system is readily installed through an existing completion.

Figure 14:
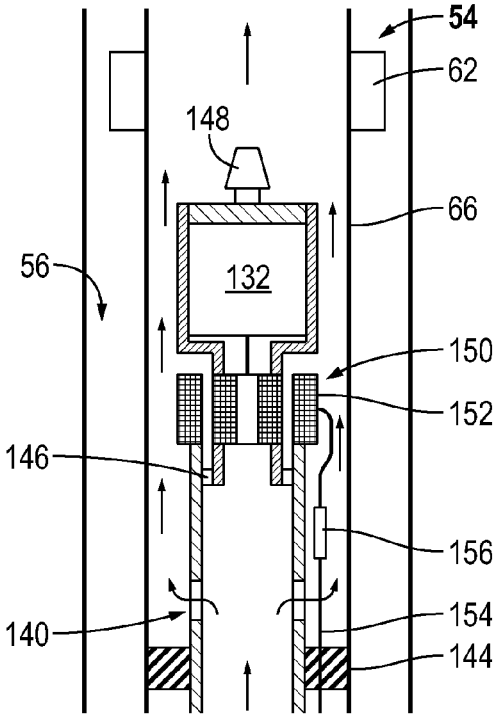
FIG. 14 is a schematic illustration of an embodiment of the retrievable power source and data storage component illustrated in FIG. 13, according to another embodiment of the disclosure.

One example of the retrievable battery/power source 132 is illustrated in greater detail in FIG. 14. In this example, the retrievable power source 132 includes a latching feature 146 by which the power source 132 is engaged with a lower completion section, stinger, or other completion component. Another latch member 148 may be located on the top or upper portion of the retrievable power source 132, and this latch member is configured to be engaged and coupled to a corresponding portion of a retrieval assembly, such as a retrieval assembly run in hole via coiled tubing or other type of delivery system. Although the power source 132 is illustrated as passing power and/or communication signals through an inductive coupling 150, e.g. an inductive coupler wet connect, other types of electrical, optical and/or hydraulic wet connectors may be employed. A female portion 152 of the inductive coupler 150 is engaged with a cable 154, e.g. a section of communication line 108, for communication of signals with the sensors and valves located below inductive coupling 150. In some embodiments, the cable 154 may be connected across an electronics cartridge 156 which is used to coordinate and control communication and/or power to the various completion components connected to cable 154.

Figure 15:
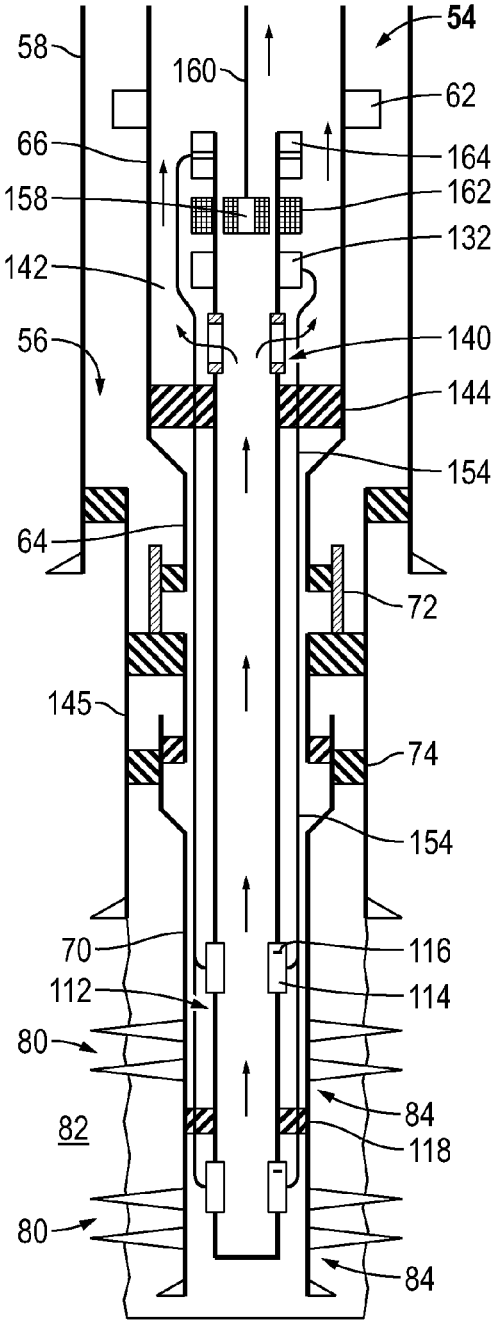
FIG. 15 is a schematic illustration of a large bore open hole completion system that utilizes periodic intervention to communicate, control, and recharge the downhole power supply, according to another embodiment of the disclosure.

Referring generally to FIG. 15, another embodiment of the completion system 54 is illustrated and is similar to the embodiment ascribed with reference to FIG. 13 in at least some aspects. However, in the embodiment illustrated in FIG. 15, a retrievable power source 158 is run in hole on a delivery cable 160 or other suitable delivery system for engagement with the lower completion section 138. The retrievable power source 158 may be coupled to the lower completion section 138 via a coupler 162, such as a hydraulic, electric, and/or optical wet connect and/or inductive coupler. In this example, the top portion of the lower completion section 138 also may include the rechargeable or retrievable battery/power source 132 used to power the sensors, e.g. sensors 116, and other electrical components of the lower completion section. In some applications, the system also utilizes a separate hydraulic wet connect 164 which may be positioned generally at the top portion of the lower completion section 138.

In some embodiments, the top portion of the lower completion section 138 also may comprise a data storage/processing component, such as data recorder 134, which may interact with the sensors, flow control valves, and/or other components. A cable, such as cable 154, is used to provide a pathway for power/data communication beneath the coupler 162. The cable 154 may form a portion of the overall communication line 108 which further extends upwardly to a power source and/or monitoring station located at the surface of the well.

Figure 16:
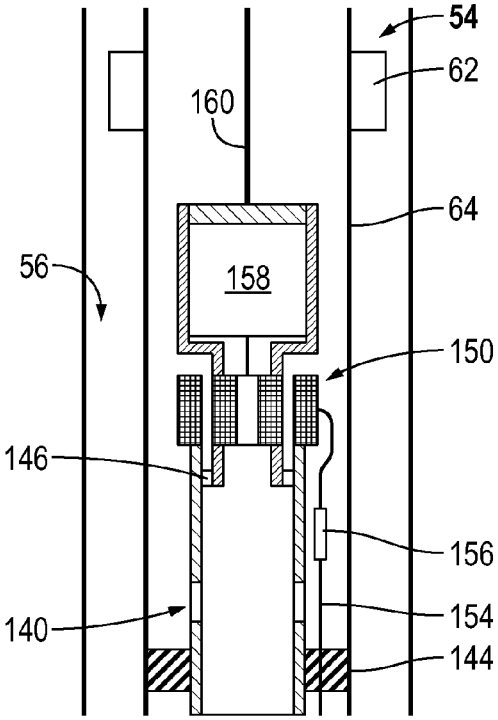
FIG. 16 is a schematic illustration of another embodiment of the retrievable power source and data communication component, according to another embodiment of the disclosure.
Figure 17:
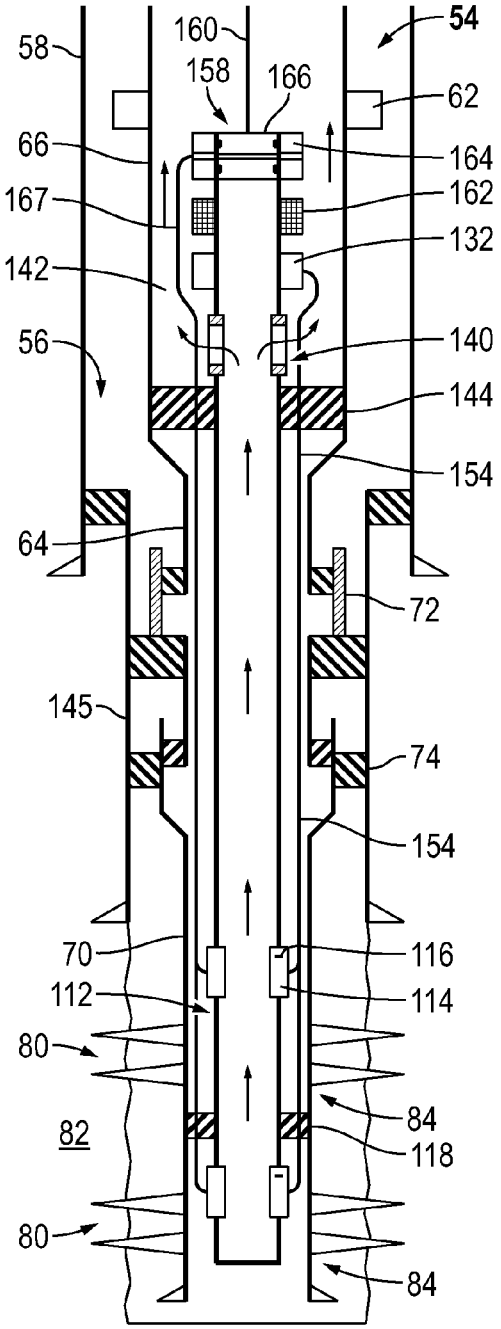
FIG. 17 is a schematic illustration of a large bore open hole completion system that utilizes periodic intervention to communicate, control, and recharge the downhole power supply, according to another embodiment of the disclosure.

One example of the retrievable power source 158 is illustrated in greater detail in FIG. 16. In this example, the retrievable power source 158 is directly connected with a delivery cable 160 which extends from a top of the retrievable power source 158 to a surface of the well. The delivery cable 160 may comprise electrical conductors, optical fibers, and/or conduits and may function as the delivery system for the retrievable power source 158. In this example, the cable 160 also is used as a pathway for data and/or power delivery. As further illustrated in FIG. 17, the retrievable power source 158 also may comprise a retrievable hydraulic wet connect portion 166 used in hydraulic wet connect 164. In this example, the cable 160 comprises a hydraulic control line for actuating one or more flow control valves of the lower completion system 138. Additionally, a section of hydraulic control line 167 extends from the hydraulic wet connect 164 down to valves 114 or to other components hydraulically controlled. Periodic intervention may be employed to communicate, control, and/or recharge the downhole power supply 132.

Figure 18:
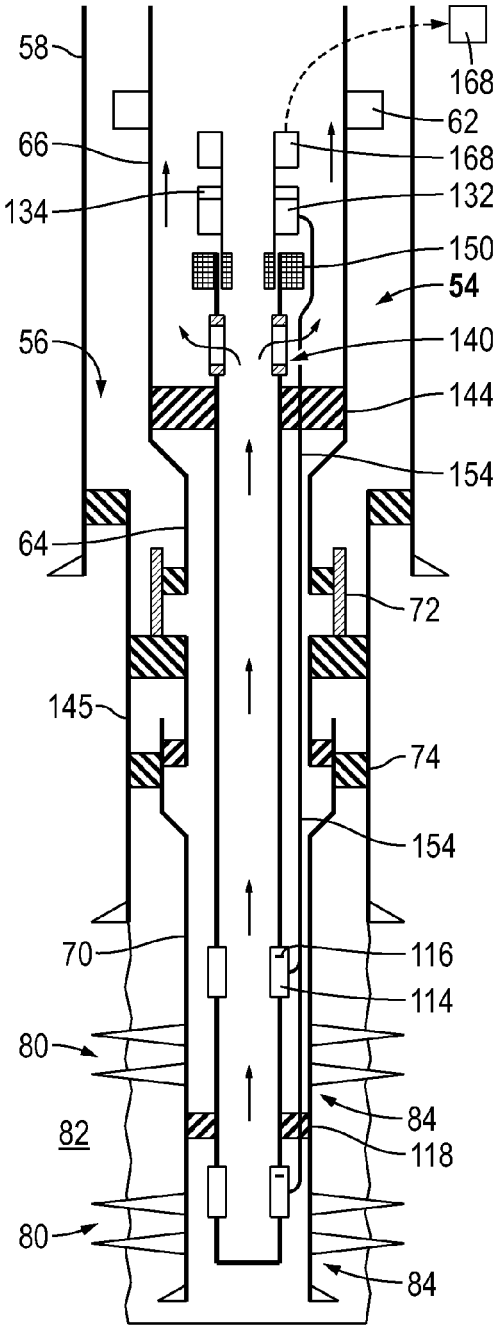
FIG. 18 is a schematic illustration of a large bore open hole completion system that utilizes periodic intervention to retrieve and/or replace the battery/power source and data storage component, according to another embodiment of the disclosure.

Referring generally to FIG. 18, another embodiment of the completion system 54 is illustrated and is similar to previously described embodiments in at least some aspects. However, in the embodiment illustrated in FIG. 18, a wireless telemetry module 168 is employed to establish a wireless connection between the retrievable power source 132 and surface systems located at a surface of the well. By way of example, this embodiment of the retrievable power source 132 may be constructed as a power generator and/or power storage device. In some embodiments, a power storage device, e.g. capacitor or battery, may be coupled with a low power generator configured to trickle charge the power storage device. The power storage device 132 also may be configured to provide a relatively continuous low power supply to the sensors, e.g. sensors 116, and an intermittent, higher power supply to operate the flow control valves 114. Periodic intervention may be employed, for example, to retrieve and/or replace power storage device 132 and/or other components, including data storage devices, e.g. storage device 134.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method for installing a large bore completion system, comprising:

real time monitoring of reservoir parameters in a well via a retrievable instrumented stinger, wherein a top portion of the retrievable instrumented stinger is landed in a tubular below a surface controlled subsurface safety valve (SCSSV);

retrieving the retrievable instrumented stinger after determining a need for controlling flow in response to the real time monitoring;

after the retrieving, running a lower completion section comprising one or more valves and one or more sensors in hole; and controlling flow by manipulating the one or more valves.

2. The method as recited in claim 1, wherein the retrievable instrumented stinger is engaged to a wet connected when landed and wherein the running comprises running the lower completion section into engagement with the wet connect.

3. The method as recited in claim 1, further comprising providing a power source downhole to power both the one or more sensors and the one or more valves along the lower completion section.

4. The method as recited in claim 1, wherein the running comprises running the lower completion section down into a lower liner section suspended by a liner hanger and seal assembly below an upper liner section.

5. The method as recited in claim 1, further comprising communicating with the lower completion section through a wet connect comprising at least one of an inductive coupler wet connect, an electrical wet connect, a hydraulic wet connect, and a fiber optic wet connect.

6. The method of claim 1, wherein the top portion is landed in a shrouded flow area.

7. The method of claim 6, wherein the tubular is production tubing.

8. The method of claim 1, wherein the top portion is landed at an anchor.

9. The method of claim 1, further comprising producing fluid through the landed retrievable instrumented stinger.

10. A system, comprising:

a large bore completion system having a lower liner section disposed in a wellbore across a well zone;

a retrievable instrumented stinger having a sensor to monitor a reservoir parameter in the well zone when the retrievable instrumented stinger is landed in the wellbore in a tubular below a surface controlled subsurface safety valve (SCSSV);

a lower completion system which is run in hole to replace the retrievable instrumented stinger upon determining a need for controlling flow, the lower completion system having a sensor and a flow control valve to control flow; and a power source located downhole to provide power to the lower completion system.

11. The system as recited in claim 10, wherein the power source is retrievable.

12. The system as recited in claim 10, wherein the large bore completion system comprises an upper liner section from which the lower liner section is suspended by a liner hanger and seal assembly.

13. The system as recited in claim 10, wherein the large bore completion system comprises an upper liner section disposed above the lower liner section but not directly coupled to the lower liner section.

14. The system as recited in claim 10, wherein the lower completion system is engaged and disengaged downhole via a wet connect.

15. The system as recited in claim 10, wherein the lower completion system is engaged and disengaged downhole via an inductive coupler.

16. The system of claim 10, wherein the retrievable instrumented stinger is landed in a shrouded flow area.

17. A method of installing a large bore completion system, comprising:

suspending a lower liner section downhole across a plurality of well zones;

landing a top portion of an instrumented stinger above the lower liner section and below a surface controlled subsurface safety valve (SCSSV), the instrumented stinger having a sensor deployed in the lower liner section;

monitoring well parameters in the lower liner section via the instrumented stinger;

retrieving the instrumented stinger;

after the retrieving, deploying a lower completion having an intelligent completion section disposed in the lower liner section, the intelligent completion section having a sensor and flow control valves;

segregating the well zones along the lower liner section with the flow control valves;

monitoring a well parameter via the intelligent completion section sensor; and based on the monitoring, manipulating individual valves of the plurality of controllable the flow control valves.

18. The method of claim 17, further comprising producing fluid from the lower liner section through the instrumented stinger.

19. The method of claim 17, wherein the top portion of the instrumented stinger is landed in a shrouded flow area provided in a tubular.

20. The method of claim 19, wherein the tubular is production tubing.

* * * * *